US010981287B2

(12) United States Patent
Liao

(10) Patent No.: US 10,981,287 B2
(45) Date of Patent: Apr. 20, 2021

(54) TUBE CUTTER WITH AUTOMATICALLY FEEDING FUNCTION AND WITH ENHANCED TORQUE

(71) Applicant: Ching-Hua Liao, Taichung (TW)

(72) Inventor: Yu-Zhu Liao, Taichung (TW)

(73) Assignee: Ching-Hua Liao, Taichung (TW)

( * ) Notice: Subject to any disclaimer, the term of this patent is extended or adjusted under 35 U.S.C. 154(b) by 0 days.

(21) Appl. No.: 16/047,144

(22) Filed: Jul. 27, 2018

(65) Prior Publication Data

US 2019/0084172 A1 Mar. 21, 2019

(30) Foreign Application Priority Data

Sep. 15, 2017 (TW) ..... 106213763

(51) Int. Cl.
*B26D 3/16* (2006.01)
*B26D 1/14* (2006.01)
*B26D 7/01* (2006.01)

(52) U.S. Cl.
CPC ..... *B26D 3/169* (2013.01); *B26D 1/14* (2013.01); *B26D 2007/013* (2013.01)

(58) Field of Classification Search
CPC .... B26D 3/169; B26D 2007/013; B26D 1/14; B23D 21/003; B23D 21/06; B23D 21/08; B23D 21/10; B23D 3/16; B23D 21/00; B26B 25/005; B26B 25/007
See application file for complete search history.

(56) References Cited

U.S. PATENT DOCUMENTS 465,415 A * 12/1891 Pottle ..... B23D 21/10 30/94
1,017,037 A * 2/1912 Borden ..... B23D 21/10 30/94
1,945,949 A * 2/1934 Myers ..... B23D 21/08 7/157
3,013,335 A * 12/1961 Kowal ..... B23D 21/08 30/94
3,403,442 A * 10/1968 Reese ..... C03B 33/14 30/164.95
6,393,700 B1 * 5/2002 Babb ..... B23D 21/08 30/101
2003/0121156 A1 * 7/2003 Walsh ..... B26D 3/169 30/97
2004/0025351 A1 * 2/2004 Lee ..... B23D 21/08 30/101
2004/0112177 A1 * 6/2004 Yip ..... B67B 7/0441 81/3.48
2004/0163264 A1 * 8/2004 Sinnonz ..... B23D 49/14 30/517

(Continued)

FOREIGN PATENT DOCUMENTS

JP 2002018636 A * 1/2002 ..... B23D 21/08

*Primary Examiner* — Kenneth E Peterson
*Assistant Examiner* — Samuel A Davies
(74) *Attorney, Agent, or Firm* — Alan D. Kamrath; Karin L. Williams; Mayer & Williams PC

(57) ABSTRACT

A tube cutter includes a main body, a holder slidably mounted on the main body, a guide bolt rotatably mounted on the main body and locked onto a lower portion of the holder to drive and move the holder forward or backward by rotation of the guide bolt, and a driving handle removably mounted on the guide bolt to drive and rotate the guide bolt, and to enhance the torque of the tube cutter.

13 Claims, 13 Drawing Sheets

(56) References Cited

U.S. PATENT DOCUMENTS

| | | | | |
|---|---|---|---|---|
| 2006/0059692 | A1* | 3/2006 | Lee | B23D 21/06<br>30/101 |
| 2009/0049697 | A1* | 2/2009 | Williams | B23D 21/08<br>30/101 |
| 2010/0088898 | A1* | 4/2010 | Thorson | B23D 21/04<br>30/95 |
| 2012/0023751 | A1* | 2/2012 | Chiu | B23D 21/08<br>30/101 |
| 2012/0247288 | A1* | 10/2012 | Hamm | B23D 21/00<br>83/13 |
| 2016/0008895 | A1* | 1/2016 | Chen | B23D 21/08<br>30/102 |
| 2016/0361829 | A1* | 12/2016 | Hyma | B23D 21/08 |
| 2017/0368705 | A1* | 12/2017 | Liao | B26D 3/169 |

* cited by examiner

TUBE CUTTER WITH AUTOMATICALLY FEEDING FUNCTION AND WITH ENHANCED TORQUE

BACKGROUND OF THE INVENTION

1. Field of the Invention

The present invention relates to a cutter and, more particularly, to a tube cutter for cutting a tube.

2. Description of the Related Art

A conventional tube cutter comprises a substantially U-shaped main body having a first end provided with a screw hole, a cutting wheel mounted on a second end of the main body, a slide movably mounted on the main body, two rollers mounted on the slide and aligning with the cutting wheel, and a threaded rod screwed through the screw hole of the main body and having a first end resting on the two rollers, and a control knob secured on a second end of the threaded rod. In operation, when the threaded rod is rotated by the control knob, the threaded rod is moved axially relative to the main body to drive the two rollers which drive the slide to move on the main body, so that the two rollers are moved relative to the cutting wheel. Thus, when the tube cutter is mounted on a tube, the two rollers rest on the tube. Then, the threaded rod is rotated by the control knob, and the two rollers are moved toward the cutting wheel, so that the tube is clamped between the two rollers and the cutting wheel. Then, the main body is held by the user's hand and is rotated relative to the tube, so that the cutting wheel is revolved on the tube so as to shear the tube gradually and successively until the tube is cut. However, the conventional tube cutter does not have an automatically feeding function so that the user has to rotate the control knob successively to move the two rollers to press the tube during the shearing process, thereby causing inconvenience to the user, and thereby wasting the energy and working time. In addition, the conventional tube cutter has a small torque so that the user has to apply a large force on the main body to rotate the main body is held by the user's hand and is rotated relative to the tube, so that the cutting wheel is revolved on the tube so as to shear the tube relative to the tube so as to shear the tube, thereby wasting the user's energy and time.

BRIEF SUMMARY OF THE INVENTION

The primary objective of the present invention is to provide a tube cutter with an automatically feeding function and with an enhanced torque.

In accordance with one aspect of the present invention, there is provided a tube cutter comprising a main body, a holder slidably mounted on the main body, a guide bolt rotatably mounted on the main body and locked onto a lower portion of the holder to drive and move the holder forward or backward by rotation of the guide bolt, and a driving handle removably mounted on the guide bolt to drive and rotate the guide bolt, and to enhance a torque of the tube cutter.

In accordance with another aspect the present invention, there is provided a tube cutter comprising a main body, a holder slidably mounted on a first side of the main body, a slide slidably mounted in the holder, a guide bolt rotatably mounted on the main body, two rollers pivotally mounted on a second side of the main body, and a cutting wheel rotatably mounted on the holder and corresponding to the two rollers.

The main body is provided with a first through hole. The holder is provided with a receiving space. The holder is provided with two second through holes located at two sidewalls of the receiving space. The slide is received in the receiving space of the holder. The slide is provided with an internal thread. Two elastic members are mounted in the receiving space of the holder and biased between the slide and the holder. The guide bolt extends through the first through hole of the main body, the two second through holes of the holder and the internal thread of the slide. The guide bolt has a first end provided with a rotation portion protruding from the first through hole of the main body and a second end provided with an external thread screwed through the internal thread of the slide. The tube cutter further comprises a driving handle removably mounted on the guide bolt to drive and rotate the guide bolt, and to enhance a torque of the tube cutter.

According to the primary advantage of the present invention, the driving handle is combined with the rotation portion of the guide bolt to enhance the torque of the tube cutter when shearing the tube, so that the operator cuts the tube easily and conveniently.

According to another advantage of the present invention, the holder is pushed by the elastic force of the elastic members, so that the cutting wheel is fed toward the tube automatically during the cutting process, so as to shear the tube successively until the tube is cut, thereby facilitating the user operating the tube cutter when cutting the tube.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
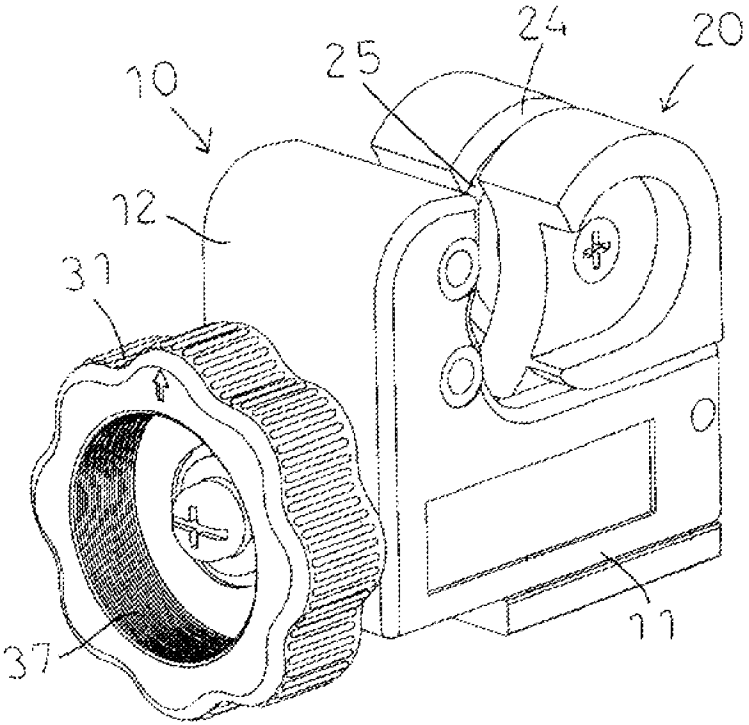
FIG. 1 is a perspective view of a tube cutter in accordance with the first preferred embodiment of the present invention.

Referring to the drawings and initially to FIGS. 1-4, a tube cutter in accordance with the preferred embodiment of the present invention comprises a main body 10, a holder 20 slidably mounted on a first side of the main body 10, a slide 33 slidably mounted in the holder 20, a guide bolt 30 rotatably mounted on the main body 10, two rollers 40 pivotally mounted on a second side of the main body 10, and a cutting wheel 25 rotatably mounted on the holder 20 and corresponding to the two rollers 40.

The main body 10 is provided with a first through hole 16 corresponding to the holder 20 and allowing passage of the guide bolt 30.

The holder 20 is provided with a receiving space 22 corresponding to the guide bolt 30. The holder 20 is provided with two second through holes 23 located at two sidewalls of the receiving space 22 and aligning with the first through hole 16 of the main body 10. The two second through holes 23 of the holder 20 allow passage of the guide bolt 30.

Figure 3:
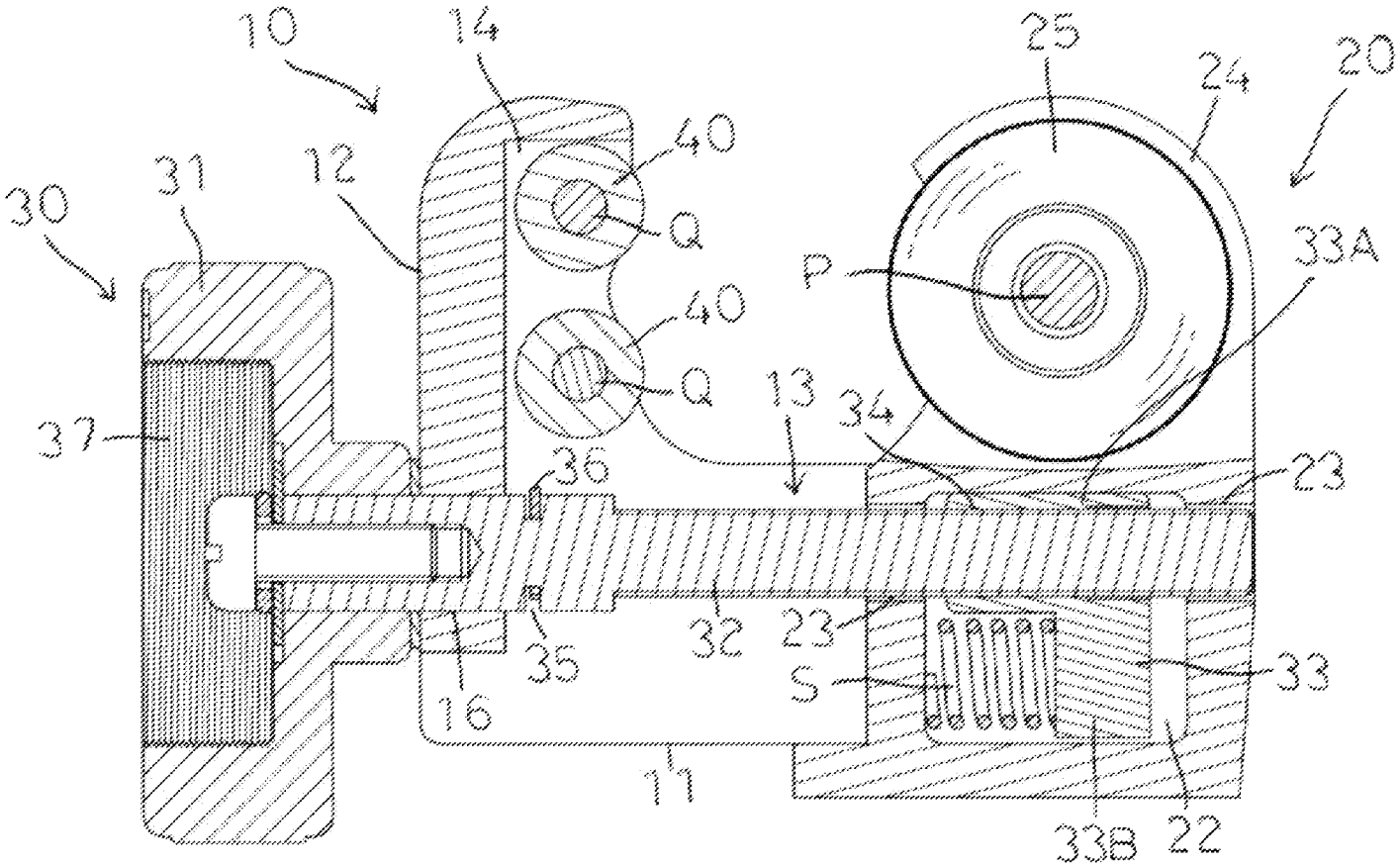
FIG. 3 is a cross-sectional view of the tube cutter in accordance with the first preferred embodiment of the present invention.

The slide 33 is received in the receiving space 22 of the holder 20 and has a height flush with that of the receiving space 22 as shown in FIG. 3. The slide 33 is provided with an internal thread 34. Two elastic members "S" are mounted in the receiving space 22 of the holder 20 and biased between the slide 33 and the holder 20. The slide 33 has an inverted L-shaped profile and includes a horizontal section 33A and a vertical section 33B.

The guide bolt 30 extends through the first through hole 16 of the main body 10, the two second through holes 23 of the holder 20 and the internal thread 34 of the slide 33. The guide bolt 30 has a first end provided with a rotation portion 31 protruding from the first through hole 16 of the main body 10 and a second end provided with an external thread 32 screwed through the internal thread 34 of the slide 33. In assembly, the external thread 32 of the guide bolt 30 initially extends through the first through hole 16 of the main body 10 and a front one of the two second through holes 23 of the holder 20, is then screwed through the internal thread 34 in the horizontal section 33A of the slide 33, and then extends through a rear one of the two second through holes 23 of the holder 20.

In practice, the slide 33 is driven by rotation of the guide bolt 30 to drive and move the holder 20 forward or backward, while the holder 20 is pushed by an elastic force of the elastic members "S", so that the cutting wheel 25 is fed automatically during a cutting process. The horizontal section 33A of the slide 33 is movable to press one of the two sidewalls of the receiving space 22 to limit a further movement of the slide 33.

In the preferred embodiment of the present invention, the main body 10 has a substantially L-shaped profile and includes a horizontal portion 11 and a vertical portion 12 located at a side of the horizontal portion 11. The horizontal portion 11 of the main body 10 is provided with a horizontal receiving channel 13, and the vertical portion 12 of the main body 10 is provided with a vertical receiving channel 14. The at least one aperture 15 of the main body 10 is formed in the horizontal portion 11 of the main body 10 and connected to the horizontal receiving channel 13. The first through hole 16 of the main body 10 is formed in the vertical portion 12 of the main body 10. The holder 20 is slidably mounted in the horizontal receiving channel 13 of the main body 10 so that the holder 20 is moved forward or backward in the horizontal receiving channel 13 of the main body 10. The two rollers 40 are pivotally mounted in the vertical receiving channel 14 of the main body 10.

In the preferred embodiment of the present invention, the holder 20 is provided with at least one slideway 21, the main body 10 is provided with at least one aperture 15, and a positioning pin (not shown) extends through the at least one aperture 15 of the main body 10 and is positioned in the at least one slideway 21 of the holder 20. Thus, the at least one slideway 21 of the holder 20 is slidably mounted in the horizontal receiving channel 13 of the main body 10 so that the holder 20 is moved forward or backward.

In the preferred embodiment of the present invention, the holder 20 is provided with a slot 24 corresponding between the two rollers 40, and the cutting wheel 25 is rotatably mounted in the slot 24 of the holder 20. The slot 24 of the holder 20 has a first sidewall provided with a through bore 26 and a second sidewall provided with a screw bore 27 coaxial with the through bore 26. The cutting wheel 25 is provided with a shaft bore 28. A shaft (such as a screw) "P" extends through the through bore 26 of the holder 20 and the shaft bore 28 of the cutting wheel 25 and is screwed into the screw bore 27 of the holder 20. Thus, the cutting wheel 25 is rotatable freely on the shaft "P".

In the preferred embodiment of the present invention, each of the two rollers 40 has a periphery provided with a receiving groove 42 to receive or avoid a protruding edge of a tube 1 to be cut.

In the preferred embodiment of the present invention, the guide bolt 30 has a mediate position provided with a retaining groove 35, and a snap ring 36 is mounted in the retaining groove 35 to prevent the guide bolt 30 from being removed from the main body 10.

In the preferred embodiment of the present invention, the vertical receiving channel 14 of the main body 10 has two sidewalls each provided with two pivot holes 17. The two rollers 40 are mounted on the main body 10 by two pivot members "Q". Each of the two rollers 40 is provided with a shaft hole 41. The two pivot members "Q" extend through the pivot holes 17 of the main body 10 and the shaft holes 41 of the two rollers 40, so that the two rollers 40 are rotatable freely in the vertical receiving channel 14 of the main body 10.

Figure 2:
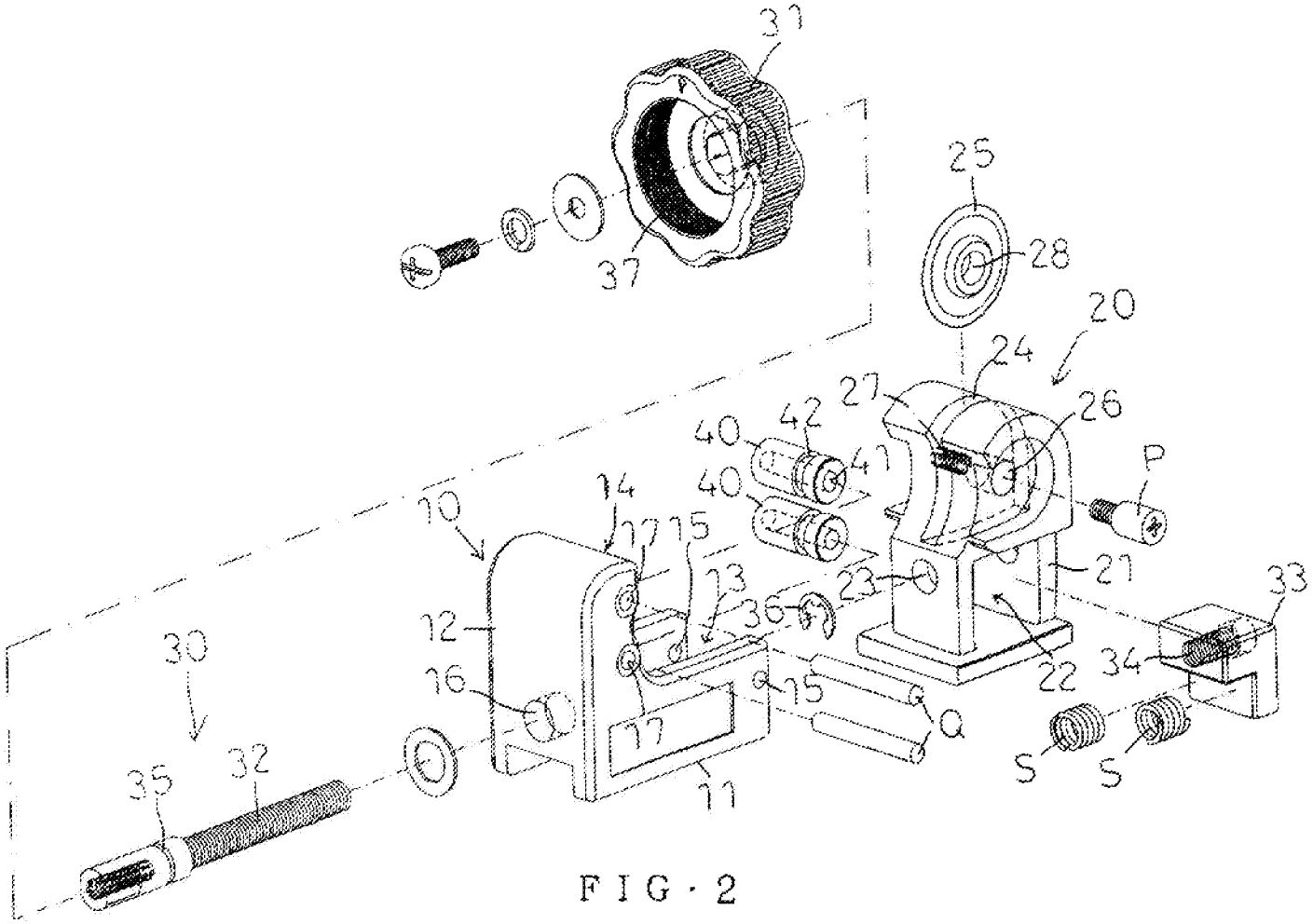
FIG. 2 is an exploded perspective view of the tube cutter in accordance with the first preferred embodiment of the present invention.
Figure 4:
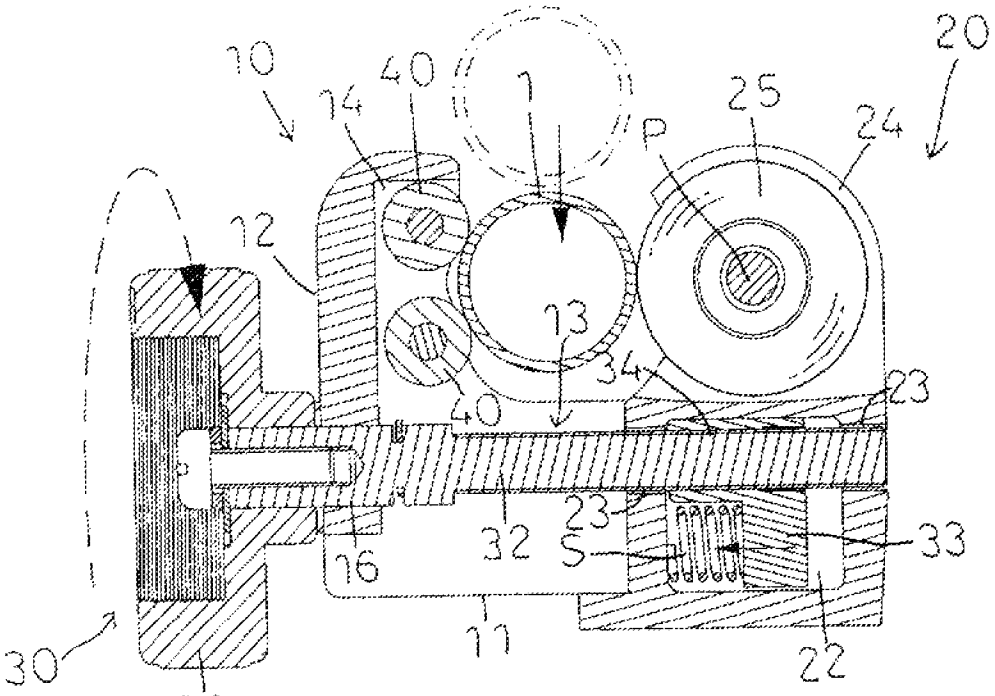
FIG. 4 is a schematic operational view of the tube cutter as shown in FIG. 3 in use.
Figure 5:
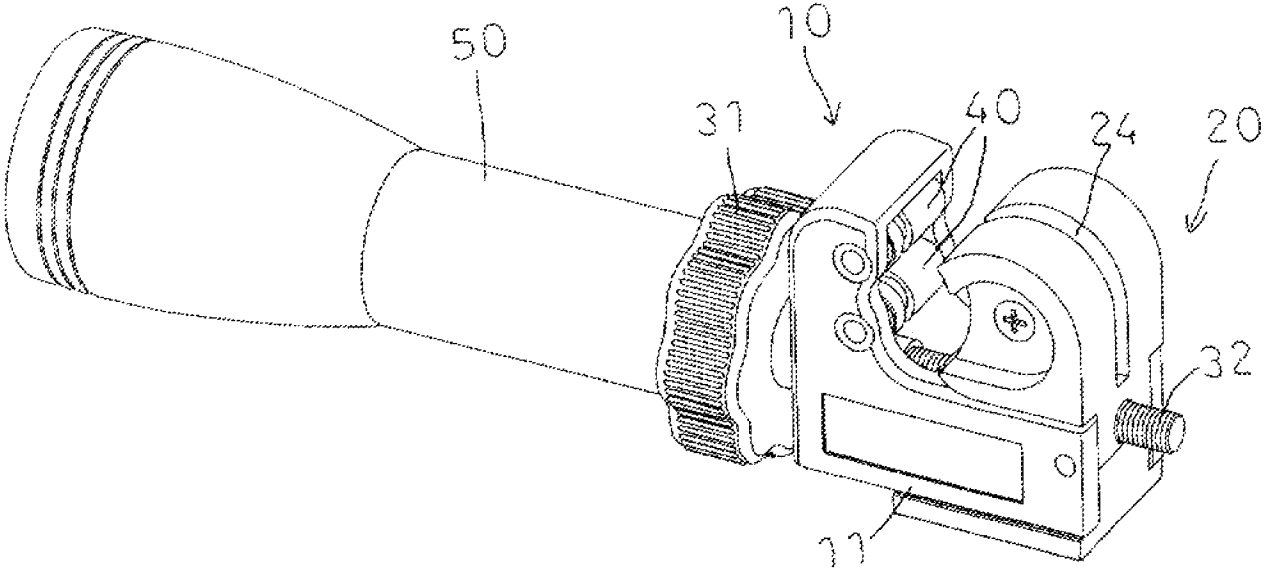
FIG. 5 is a perspective view of a tube cutter in accordance with the second preferred embodiment of the present invention.
Figure 6:
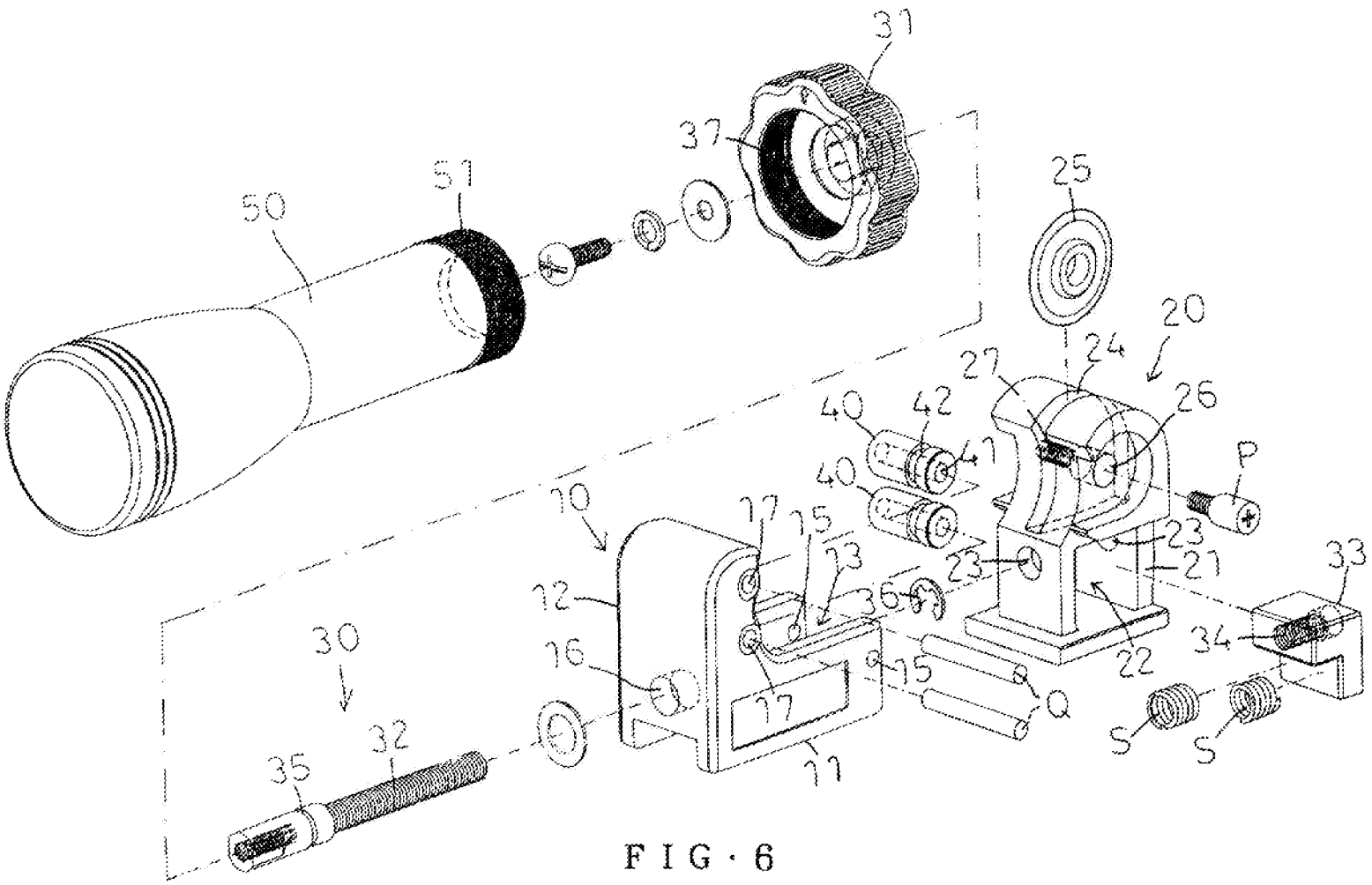
FIG. 6 is an exploded perspective view of the tube cutter in accordance with the second preferred embodiment of the present invention.
Figure 7:
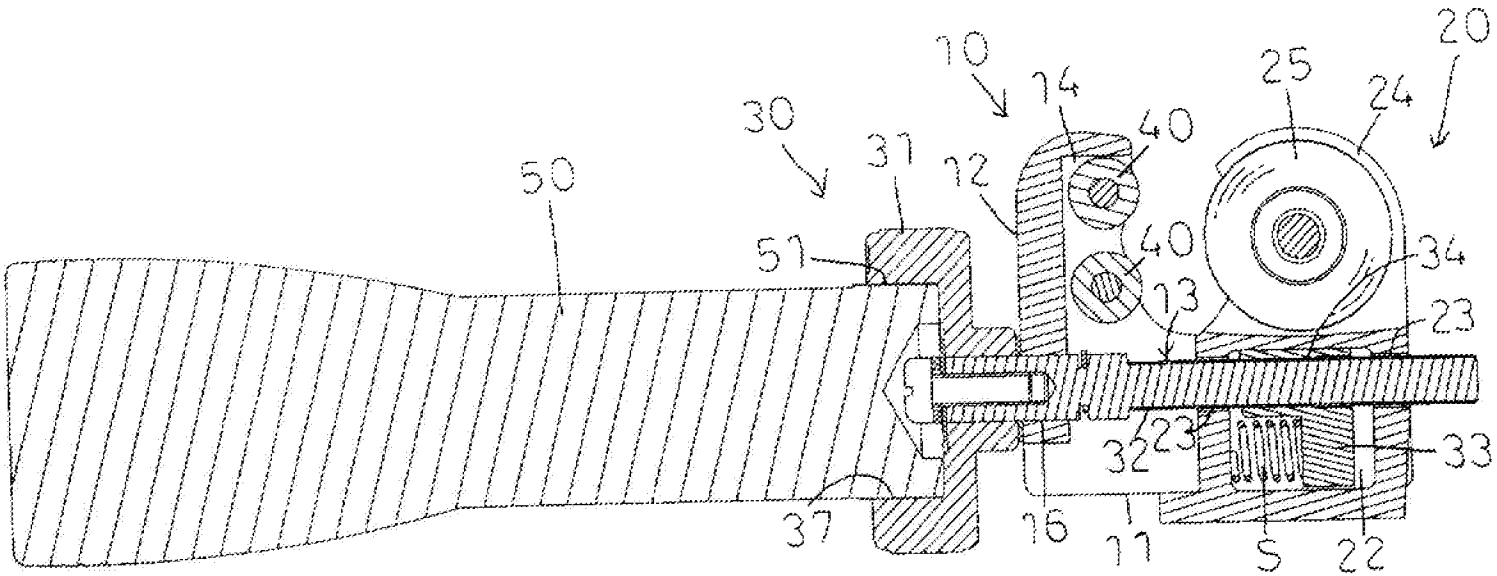
FIG. 7 is a cross-sectional view of the tube cutter in accordance with the second preferred embodiment of the present invention.
Figure 8:
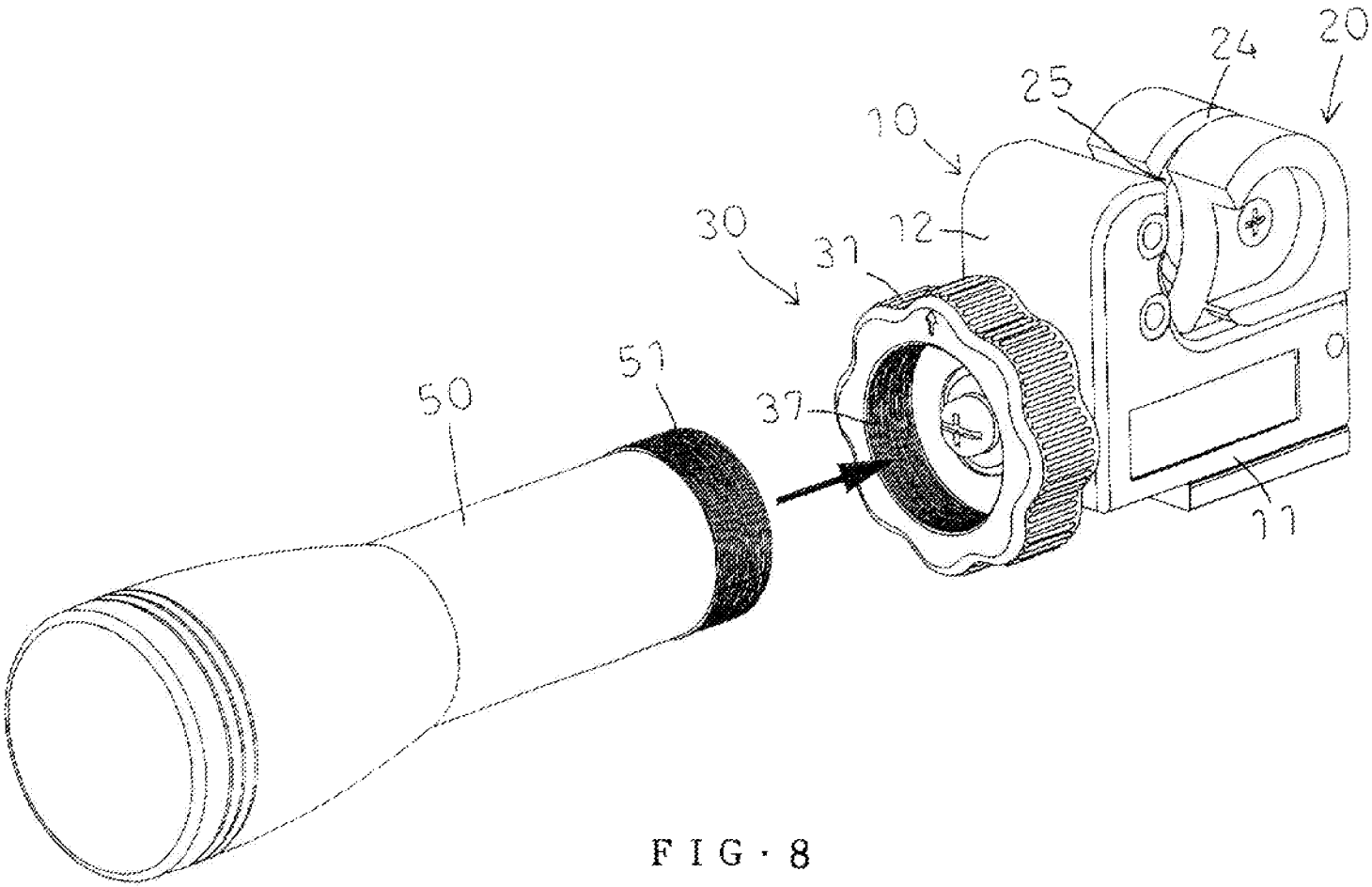
FIG. 8 is a partially perspective assembly view of the tube cutter in accordance with the second preferred embodiment of the present invention.

In operation, referring to FIGS. 3 and 4 with reference to FIGS. 1 and 2, when the tube cutter is used to shear a workpiece, such as a tube 1, the tube 1 is inserted between the two rollers 40 and the cutting wheel 25 as shown in FIG. 4, so that the two rollers 40 and the cutting wheel 25 form a three-point contact state to support the tube 1 solidly and stably. At this time, the holder 20 is pressed by the tube 1 to compress the elastic members "S". Then, the main body 10 and the holder 20 are held by the user's fingers and are rotated relative to the tube 1, so that the cutting wheel 25 is revolved on the tube 1 reciprocally so as to shear the tube 1 gradually and successively until the tube 1 is cut. At the same time, the holder 20 is pushed by the elastic force of the elastic members "S", so that the cutting wheel 25 is fed toward the tube 1 automatically during the cutting process, so as to shear the tube 1 successively. It is appreciated that, the external thread 32 of the guide bolt 30 is screwed into the internal thread 34 of the slide 33, so that when the guide bolt 30 is rotated by the rotation portion 31, the slide 33 is displaced in the receiving space 22 of the holder 20, and is moved forward or backward to compress or loosen the elastic members "S", so as to regulate the tension and restore the elastic force of the elastic members "S". In such a manner, the elastic force of the elastic members "S" is regulated by rotation of the guide bolt 30 so as to correspond to and match the thickness of the tube 1, so that the cutting wheel 25 engages the tube 1 closely and tightly.

Referring to FIGS. 5-11, the tube cutter further comprises a driving handle 50 removably mounted on the rotation portion 31 of the guide bolt 30 to drive and rotate the rotation portion 31 of the guide bolt 30, so as to enhance the torque of the tube cutter when cutting the tube 1. The rotation portion 31 of the guide bolt 30 is provided with an inner thread 37, and the driving handle 50 is provided with an outer thread 51 screwed into the inner thread 37 of the rotation portion 31 of the guide bolt 30.

Figure 9:
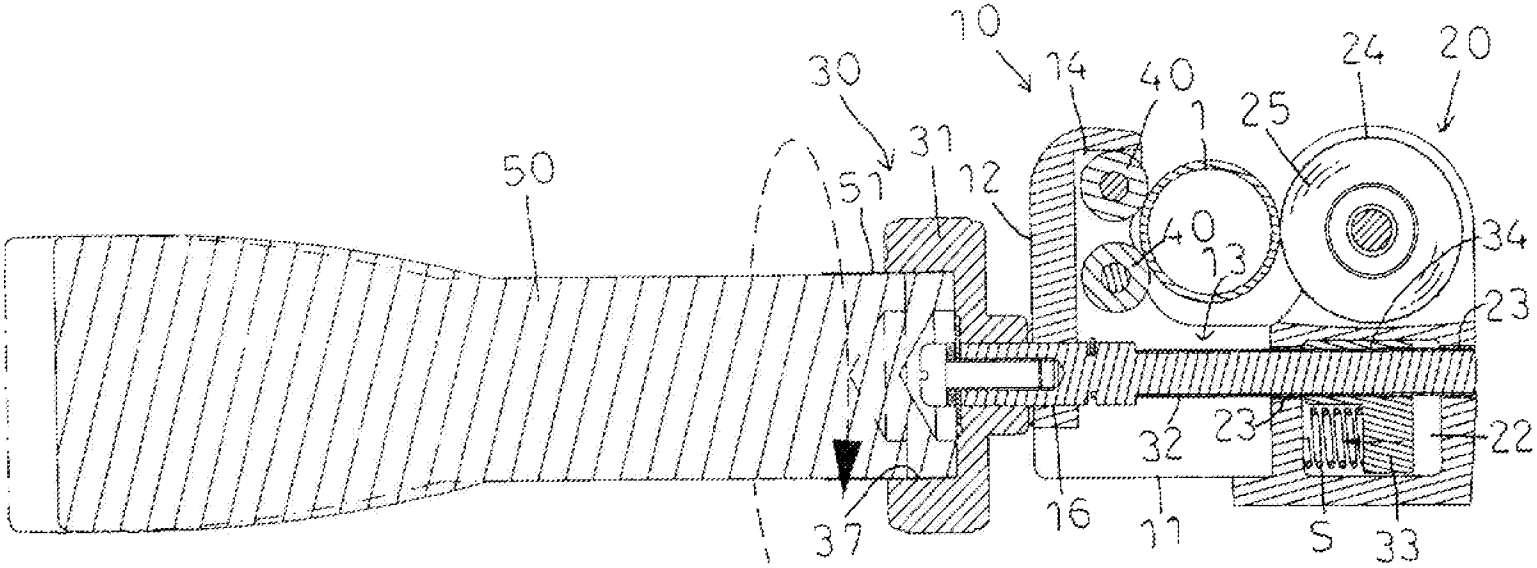
FIG. 9 is a schematic operational view of the tube cutter as shown in FIG. 7 in use.
Figure 10:
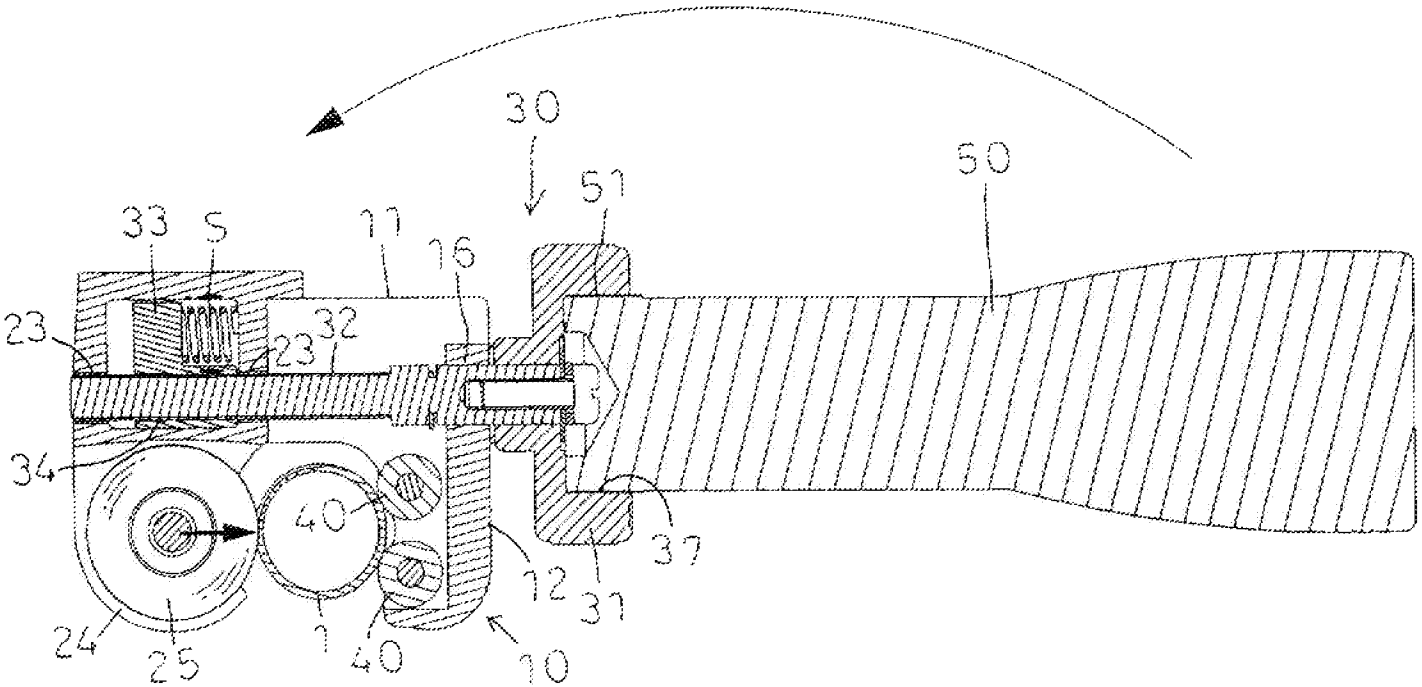
FIG. 10 is another schematic operational view of the tube cutter as shown in FIG. 7 in use.
Figure 11:
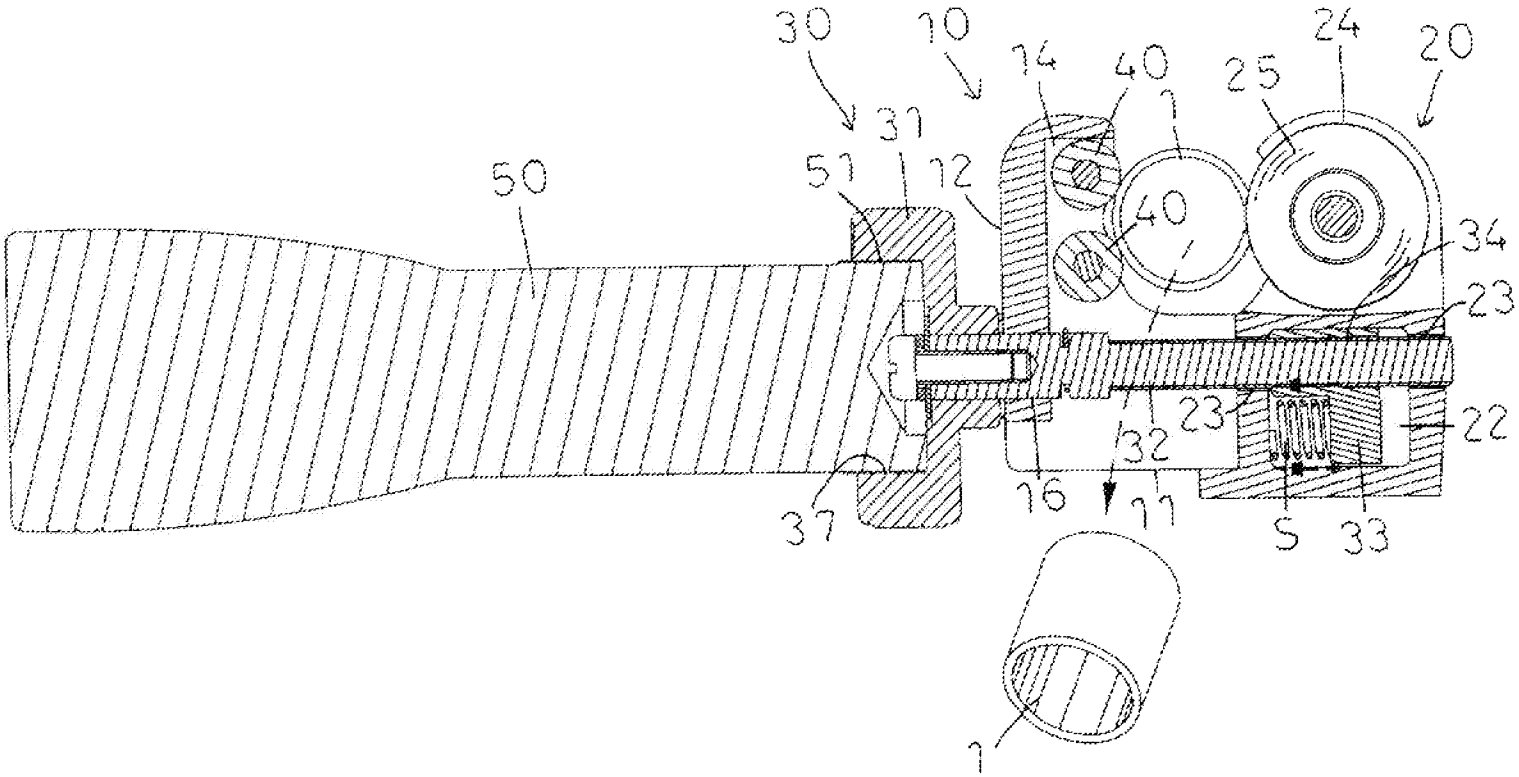
FIG. 11 is a schematic operational view of the tube cutter as shown in FIG. 10.

In operation, the user only needs to hold the driving handle 50 to drive the rotation portion 31 of the guide bolt 30, and to drive the holder 20 and the cutting wheel 25 so as to cut the tube 1. As shown in FIG. 9, the rotation portion 31 of the guide bolt 30 is rotated by the driving handle 50. As shown in FIG. 10, the rotation portion 31 of the guide bolt 30 is driven by the driving handle 50 to revolve relative to the tube 1, so that the cutting wheel 25 is driven to move on the tube 1 reciprocally so as to shear the tube 1 until the tube 1 is cut as shown in FIG. 11. At this time, the cutting wheel 25 is fed toward the tube 1 automatically during the cutting process by the elastic force of the elastic members "S", so as to shear the tube 1 successively. In such a manner, the torque of the tube cutter is enhanced greatly by provision of the driving handle 50.

Figure 12:
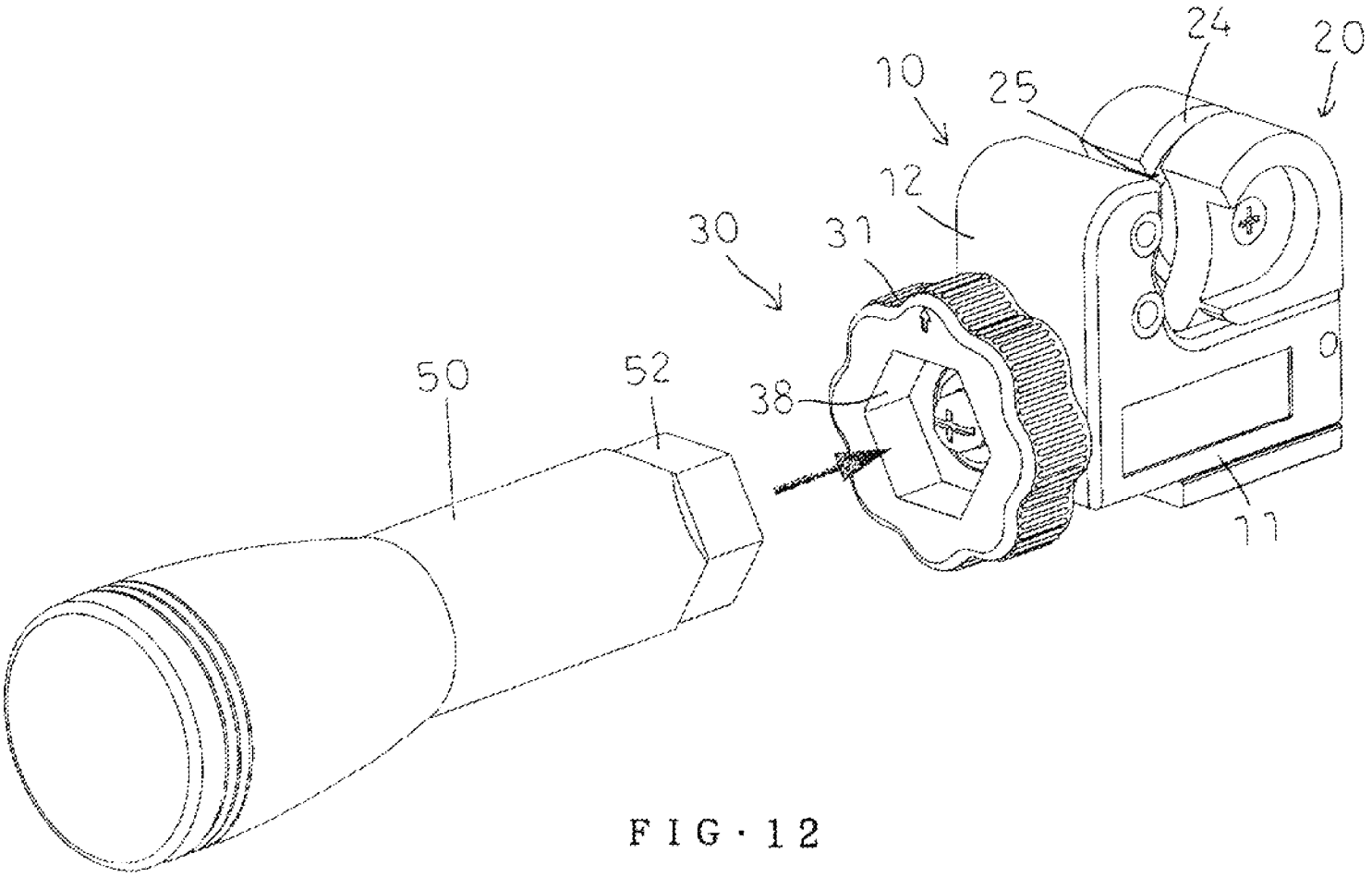
FIG. 12 is a perspective view of a tube cutter in accordance with the third preferred embodiment of the present invention.
Figures 13, 14:
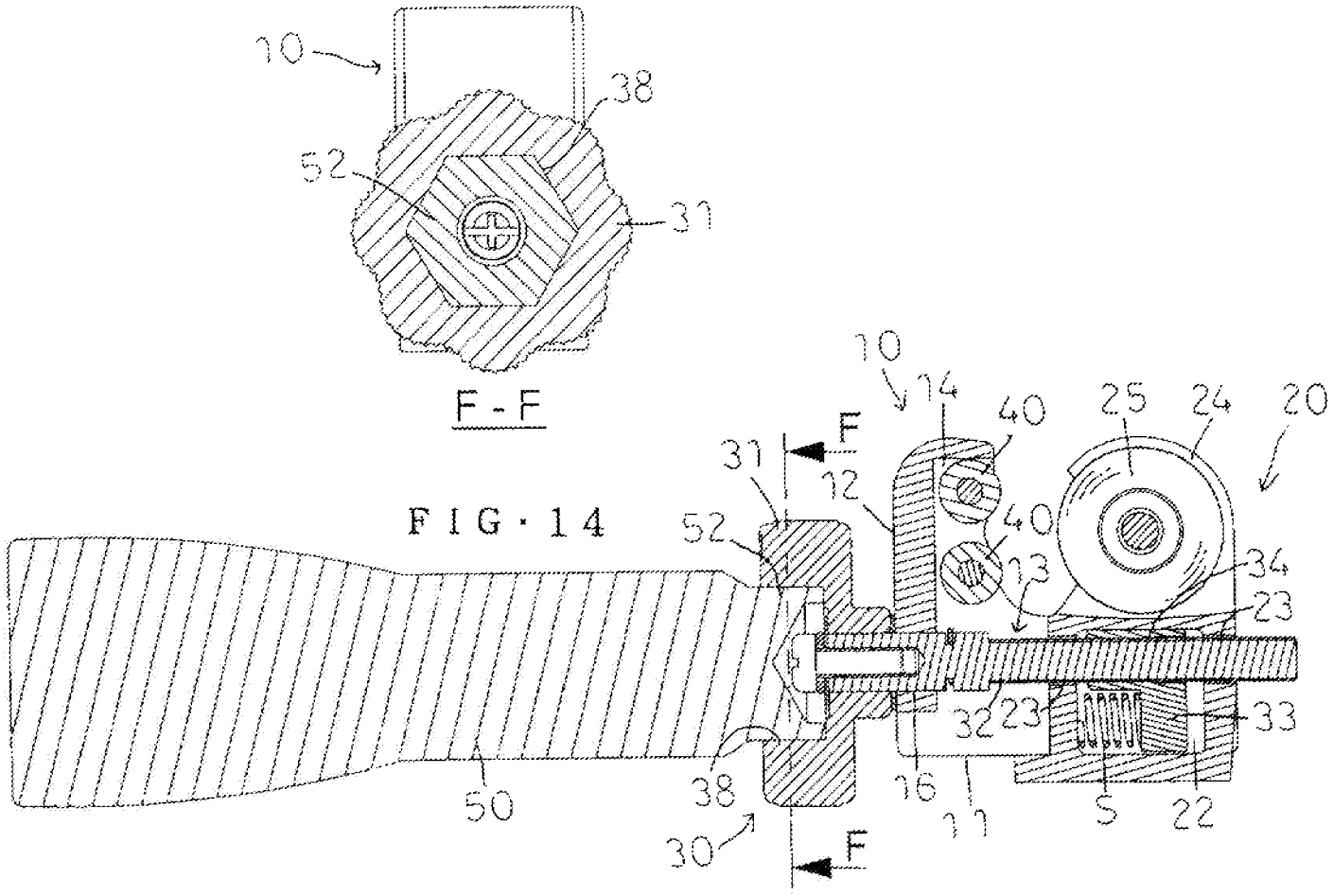
FIG. 13 is a cross-sectional view of the tube cutter in accordance with the third preferred embodiment of the present invention.
FIG. 14 is a top planar cross-sectional assembly view of the tube cutter taken along line F-F as shown in FIG. 13.

Referring to FIGS. 12-14, the rotation portion 31 of the guide bolt 30 is provided with a mounting recess 38, and the driving handle 50 is provided with a mounting protrusion 52 inserted into the mounting recess 38 of the rotation portion 31 of the guide bolt 30, so that the driving handle 50 is combined with the rotation portion 31 of the guide bolt 30. Preferably, the mounting recess 38 of the rotation portion 31 of the guide bolt 30 and the mounting protrusion 52 of the driving handle 50 have a noncircular shape (such as square, hexagonal and the like).

Accordingly, the driving handle 50 is combined with the rotation portion 31 of the guide bolt 30 to enhance the torque of the tube cutter when shearing the tube 1, so that the operator cuts the tube 1 easily and conveniently. In addition, the holder 20 is pushed by the elastic force of the elastic members "S", so that the cutting wheel 25 is fed toward the tube 50 automatically during the cutting process, so as to shear the tube 50 successively until the tube 50 is cut, thereby facilitating the user operating the tube cutter when cutting the tube 50. Further, the driving handle 50 has a small volume and a light weight, so that when the driving handle 50 is removed from the guide bolt 30, the driving handle 50 is carried easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A tube cutter comprising:

a main body;

a holder slidably mounted on the main body;

a slide slidably mounted in the holder;

a guide bolt rotatably mounted on the main body;

two rollers pivotally mounted on the main body; and a cutting wheel rotatably mounted on the holder and corresponding to the two rollers;

wherein:

the main body is provided with a first through hole;

the holder is provided with a receiving space;

the holder is provided with two second through holes located at two sidewalls of the receiving space;

the slide is received in the receiving space of the holder;

the slide is provided with a threaded hole;

the slide has an inverted L-shaped profile and includes a horizontal section and a vertical section;

the horizontal section of the slide is movable to press one of the two sidewalls of the receiving space to limit a further movement of the slide;

two elastic members are mounted in the receiving space of the holder and biased between the slide and the holder;

the guide bolt extends through the first through hole of the main body, the two second through holes of the holder and the threaded hole of the slide;

the guide bolt has a first end provided with a rotation portion protruding from the first through hole of the main body and a second end provided with an external thread screwed through the threaded hole of the slide; and the tube cutter further comprises a driving handle removably mounted on the guide bolt to drive and rotate the guide bolt;

the main body has an L-shaped profile and includes a first portion and a second portion perpendicular to each other;

the first portion of the main body is provided with a first receiving channel;

the second portion of the main body is provided with a second receiving channel;

the holder is slidably mounted in the first receiving channel of the main body; and the two rollers are pivotally mounted in the second receiving channel of the main body.

2. The tube cutter of claim 1, wherein:

the holder is provided with a slot corresponding between the two rollers;

the cutting wheel is rotatably mounted in the slot of the holder;

the slot of the holder has a first sidewall provided with a through bore and a second sidewall provided with a screw bore coaxial with the through bore;

the cutting wheel is provided with a shaft bore; and a shaft extends through the through bore of the holder and the shaft bore of the cutting wheel and is screwed into the screw bore of the holder.

3. The tube cutter of claim 1, wherein the guide bolt has a mediate position provided with a retaining groove, and a snap ring is mounted in the retaining groove to prevent the guide bolt from being removed from the main body.

4. The tube cutter of claim 1, wherein the rotation portion of the guide bolt is provided with an inner thread, and the driving handle protrudes from the rotation portion of the guide bolt and is provided with an outer thread screwed into the inner thread of the rotation portion of the guide bolt.

5. The tube cutter of claim 1, wherein the rotation portion of the guide bolt is provided with a mounting recess, the driving handle protrudes from the rotation portion of the guide bolt and is provided with a mounting protrusion inserted into the mounting recess of the rotation portion of the guide bolt, so that the driving handle is combined with the rotation portion of the guide bolt, and the mounting recess of the rotation portion of the guide bolt and the mounting protrusion of the driving handle have a noncircular shape.

6. The tube cutter of claim 1, wherein the slide is movable between the two sidewalls of the receiving space of the holder, and the horizontal section and the vertical section of the slide are moved simultaneously when the slide is moved.

7. The tube cutter of claim 6, wherein the slide is limited by the two sidewalls of the receiving space of the holder, and the horizontal section of the slide is an elongate flat plate.

8. The tube cutter of claim 1, wherein the receiving space of the holder has a dimension greater than that of each of the two second through holes of the holder.

9. The tube cutter of claim 1, wherein each of the two elastic members is arranged in a space defined between the horizontal section and the vertical section of the slide.

10. The tube cutter of claim 1, wherein the threaded hole is formed in the horizontal section of the slide, and each of the two elastic members is biased between the vertical section of the slide and one of the two sidewalls of the receiving space of the holder.

11. The tube cutter of claim 1, wherein each of the two elastic members is spaced from each of the two second through holes of the holder.

12. The tube cutter of claim 1, wherein each of the two elastic members is spaced from the guide bolt.

13. The tube cutter of claim 1, wherein the driving handle has an elongate shape.

* * * * *